United States Patent [19]

MacMillan

[11] 4,038,899

[45] Aug. 2, 1977

[54] MUSICAL INSTRUMENT TUNING APPARATUS

[76] Inventor: Roderic A. MacMillan, 2757 SW. English Court, Portland, Oreg. 97201

[21] Appl. No.: 658,612

[22] Filed: Feb. 17, 1976

[51] Int. Cl.[2] ..... G10G 7/02

[52] U.S. Cl. ..... 84/454

[58] Field of Search ..... 84/454

[56] References Cited

U.S. PATENT DOCUMENTS

| | | | |
|---|---|---|---|
| 2,221,523 | 11/1940 | Railsback | 84/454 |
| 2,679,782 | 6/1954 | Ryder | 84/454 |
| 3,481,240 | 12/1969 | Conway | 84/454 |

*Primary Examiner*—Stephen J. Tomsky

*Attorney, Agent, or Firm*—Kolisch, Hartwell, Dickinson & Stuart

[57] ABSTRACT

Apparatus for turning a strobe wheel to assist in tuning a musical instrument. The apparatus features side-by-side rotary shafts, including a driving shaft and a driven shaft—the former having uniform outside diameter along its length, and the latter having a taper along its length which taper is based on the mathematical formula that determines the intervals between successive notes in such an instrument. The driving wheel is turned at selected substantially constant speeds. The driven shaft is turned through an endless band which couples the shafts. The latter-mentioned shaft is intended for driving a strobe wheel.

11 Claims, 6 Drawing Figures

MUSICAL INSTRUMENT TUNING APPARATUS

BACKGROUND AND SUMMARY OF THE INVENTION

This invention pertains to apparatus for tuning the notes of a musical instrument. More particularly, it pertains to such apparatus which is of the type that employs a rotary strobe wheel.

It is common practice today in the tuning of a musical instrument, such as a piano or harpsichord, to use a strobe-wheel-type tuning device wherein a rotary strobe wheel is turned in front of a flashing lamp, the flashes of which occur at the frequency of the particular note in the instrument which is being tuned at a given time. In such a device, the particular speed at which the strobe wheel turns is a matter of adjustment—this speed being adjusted each time that a different not in the usual scale of notes is to be tuned. It is obviously important that in such a device the selected rotational speed of the strobe wheel be accurately and easily adjustable. To this end, it is desirable to maintain the overall construction of such a tuning device as simple as possible so as to minimize the likelihood of inaccuracy.

A general object of the present invention is to provide a unique strobe-wheel-type tuning device wherein the above considerations are taken into account in a very practical and satisfactory manner.

More particularly, an object of the invention is to provide such a tuning device wherein extremely accurate control is provided for controlling the speed of a rotary strobe wheel.

Another object of the invention is to provide a device of the type generally indicated which is characterized by extremely simple construction.

Still a further object of the invention, and one that is directly related to the immediately preceding object, is to provide a tuning device which is of relatively low cost construction despite its high degree of accuracy.

According to a preferred embodiment of the invention, apparatus is provided for turning a conventional strobe wheel—this apparatus featuring side-by-side rotary shafts including a driving shaft and a driven shaft—the former having a uniform outside diameter, and the latter having a taper which is based on the mathematical formula that determines the usual intervals between successive notes in most conventional musical instruments. The driving shaft is turned at a selected sustantially constant speed. The driven shaft is turned through an endless elastic band which couples the two shafts. The latter-mentioned shaft is directly coupled to a strobe wheel.

As is widely recognized by musicians, and by people who tune musical instruments, it is now substantially universally accepted that the thirteen sounds of a musical Octave are distributed, frequency-wise, in accordance with what is known as the Equal Tempered Scale, wherein between the 13 separate sounds there are twelve successive equal semitones. The frequency ratio of the equalized semitones is the twelfth root of the Octave ratio 1:2, or 1:1.0594631. The number 1.0594631 will be referred to also herein by the letter *b*. In other words, there is a definite mathematical formula, based on this division of the Octave into twelve semitones, which can be used to express the frequencies of successive notes in the different octaves. This formula is as follows:

$$F_n = F_O \times b^n$$

where:

$F_n$ is the desired frequency of the nth note above the lowest note of the instrument, $F_O$ is the frequency of the lowest not in the instrument, and $n$ is the number of the desired note above the lowest note in the instrument.

The taper of the driven shaft mentioned above is derived herein, as will shortly be explained, in accordance with the above mathematical formula.

Various other objects and advantages and features which are attained and offered by the present invention will become more fully apparent as the description which now follows is read in conjunction with the accompanying drawings.

DETAILED DESCRIPTION OF THE INVENTION

Figure 1:
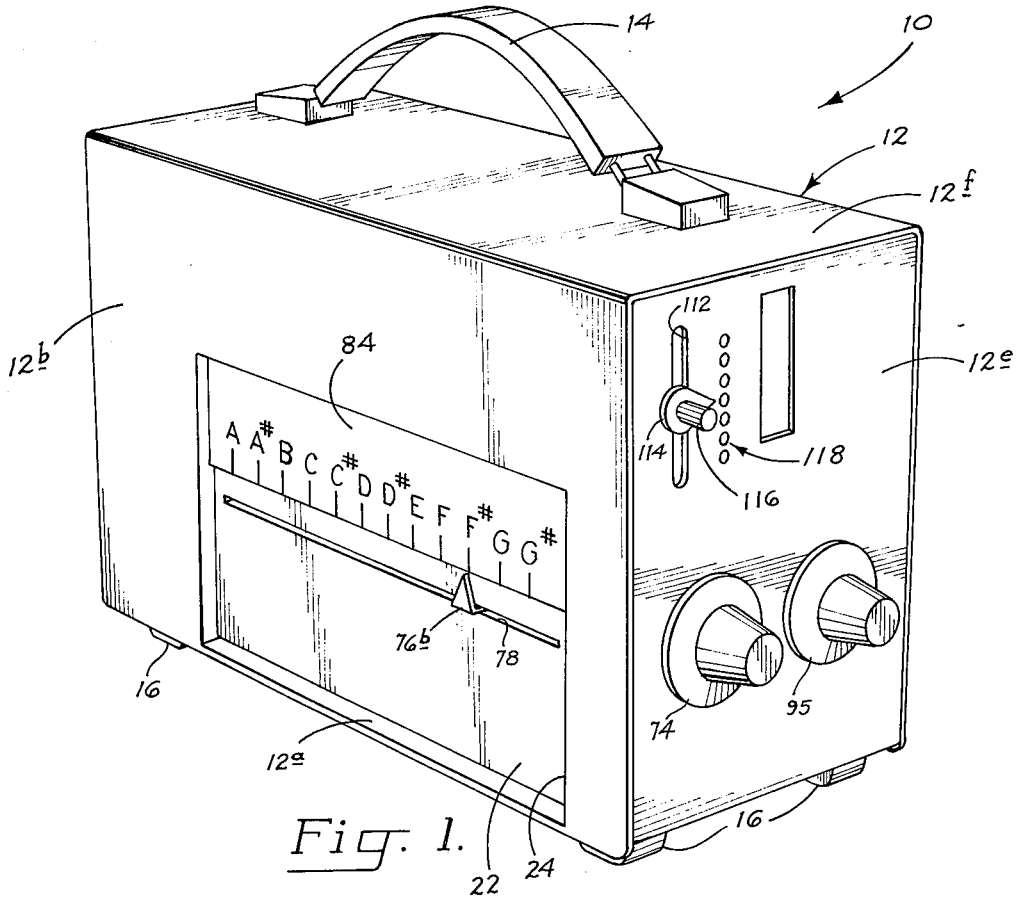
FIG. 1 is a perspective view illustrating a tuning device constructed in accordance with the present invention.
Figure 2:
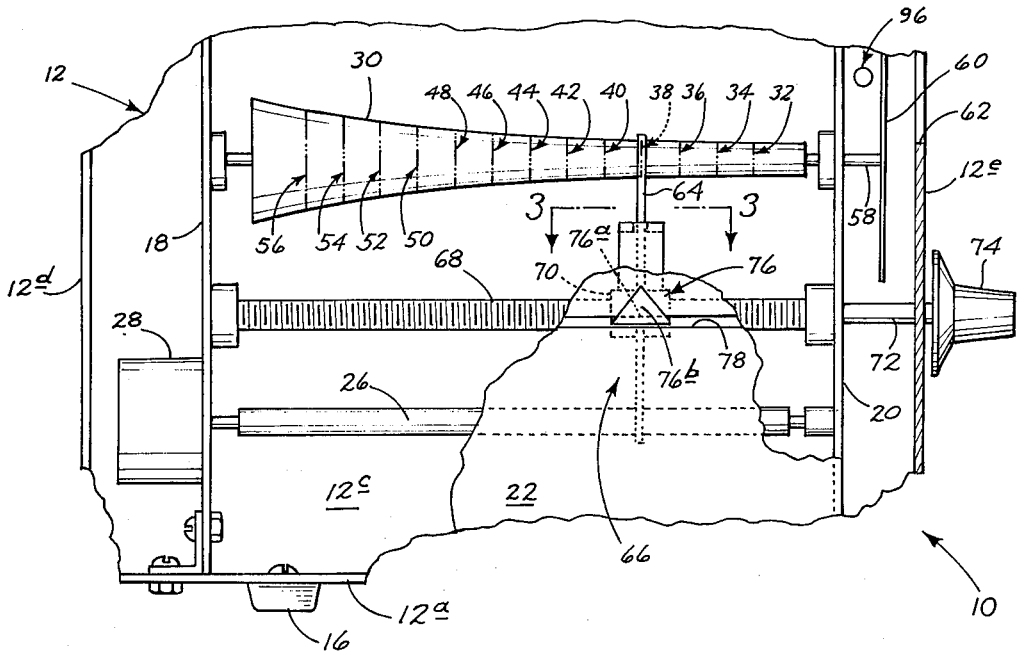
FIG. 2 is a fragmentary, and somewhat schematic, front interior view of portions of the device of FIG. 1, illustrating details of construction.

Turning now to the drawings and referring particularly to FIGS. 1 and 2, indicated generally at 10 is a tuning device which incorporates apparatus constructed in accordance with the present invention. Device 10 includes a housing 12 having a base 12*a*, front and back sides 12*b*, 12*c*, respectively, ends 12*d*, 12*e*, and a top 12*f*. Although size is not a feature of the present invention, it is interesting to note that device 10 has a relatively compact size, with housing 12 herein having a length of about 7 inches, a height of about 5 inches, and a depth or width of about $3\frac{1}{2}$ inches.

A carrying handle 14 is provided which is attached to top 12*f*, and 4 feet, such as those shown at 16, are suitably mounted on the underside of base 12*a*.

Also mounted on base 12*a*, within the housing, are two upright plates 18, 20 which lie in planes substantially paralleling the planes of ends 12*d*, 12*e* in the housing. As can be seen in FIG. 2, plate 18 is located adjacent end 12*d*, and plate 20 adjacent end 12*e*. Interconnecting plates 18, 20 along the front side of the device is another upright plate 22 which is exposed, as can be seen in FIG. 1, by a rectangular cutout 24 provided in front side 12*b* of the housing.

Suitably journaled on and extending between plates 18, 20, near the lower ends of these plates, is an elongated, substantially uniform-diameter shaft 26, which is referred to herein as a driving shaft. This shaft may be formed of any suitable material. In the embodiment of the invention now being described, shaft 26 has the substantially uniform diameter of about 0.2500 inches.

Shaft 26 herein has an overall length of about six inches. The left end of shaft 26 in FIG. 2 is drivingly connected to the output shaft of a synchronous electric motor 28 which is suitably mounted on plate 18 in the space between this plate and end **12*d* of the housing. Motor 28 is of conventional construction and is intended for operation by the usual 110–120 volt, 60 Hz. household-type AC power. When energized, the motor turns shaft 26** at the substantially constant speed of 3600 rpm.

Also suitably journaled on and extending between plates 18, 20, and disposed somewhat above shaft 26, is another shaft 30. Shaft 30 is referred to herein as a driven shaft, and is oriented so as to have its rotational axis substantially parallel to that of shaft 26. Shaft 30 may be formed of any suitable material.

According to an important feature of the present invention, shaft 30 is formed with an outside surface of revolution which is tapered in accordance with the mathematical formula (mentioned earlier) that defines the frequency intervals between successive semitones in the various musical octaves. Simply for the purpose of better illustrating this feature of the invention, shaft 30 is illustrated in FIG. 2 with a grossly distorted taper which is intended to be but illustrative of the actual taper in the shaft. As can be seen, shaft 30 tapers from a large outside diameter adjacent its left end toward a considerably smaller outside diameter adjacent its right end in FIG. 2.

Considering more specifically the construction of shaft 30, and referring again to the mathematical formula mentioned, this formula is $$F_n = F_O \times b^n$$

where:

$F_n$ is the desired frequency of the nth note above the lowest note of the instrument, $F_O$ is the frequency of the lowest not in the instrument, and $n$ is the number of the desired note above the lowest note in the instrument.

Although there are certain instances where another standard is used, in most musical circles today, so-called middle A has been assigned the frequency of 440 Hz. Device 10 has been constructed herein in accordance with that standard. With this standard being in effect, the specific frequencies which must be associated with the other notes distributed throughout the usual 7⅓ octaves of a piano are as indicated by Table I.

TABLE I

| Octave | Note A | A# | B | C | C# | D | D# | E | F | F# | G | G# |
|---|---|---|---|---|---|---|---|---|---|---|---|---|
| 1 | 27.50 | 29.13 | 30.86 | 32.70 | 34.64 | 36.70 | 38.89 | 41.20 | 43.65 | 46.24 | 48.99 | 51.91 |
| 2 | 55.00 | 58.27 | 61.73 | 65.40 | 69.28 | 73.40 | 77.78 | 82.40 | 87.30 | 92.48 | 97.98 | 103.82 |
| 3 | 110.00 | 116.54 | 123.46 | 130.80 | 138.56 | 146.80 | 155.56 | 164.80 | 174.60 | 184.96 | 195.96 | 207.64 |
| 4 | 220.00 | 233.08 | 246.92 | 261.60 | 277.12 | 293.60 | 311.12 | 329.60 | 349.20 | 369.92 | 391.92 | 415.28 |
| 5 | 440.00 | 466.16 | 493.84 | 523.20 | 554.24 | 587.20 | 622.24 | 659.20 | 698.40 | 739.84 | 783.84 | 830.56 |
| 6 | 880.00 | 932.32 | 987.68 | 1046.40 | 1108.48 | 1174.40 | 1244.48 | 1318.40 | 1396.80 | 1479.68 | 1567.68 | 1661.12 |
| 7 | 1760.00 | 1864.64 | 1975.36 | 2092.80 | 2216.96 | 2348.80 | 2488.96 | 2636.80 | 2793.60 | 2959.36 | 3135.36 | 3322.24 |
| 8 | 3520.00 | 3729.28 | 3950.72 | 4185.60 | | | | | | | | |

These same specific frequencies would, of course, apply to the corresponding notes in instruments other than a piano. A modification of the invention will be mentioned later wherein it will be seen that it is an extremely simple matter to adapt device 10 to any other standard than A-440.

As an arbitrary matter, it was decided herein that the outside diameter of shaft 30, adjacent its right end in FIG. 2 should be relatively close in size to the outside diameter of shaft 26, and should increase in size progressing to the left along shaft 30. In this connection, it was further decided that this starting diameter, so-to-speak, for shaft 30 should be related to the frequency of 55 Hz which is assigned to note A in the second octave presented in Table I above. A simple ratio was therefore set up mathematically to determine the required outside diameter for this point on shaft 30. The location along shaft 30 which is now being referred to is indicated in FIG. 2 by dash-double-dot line 32. The mathematical equation for deriving the required diameter X at location 32 is as follows:

$$X = (.2500) \times \frac{60}{55} = .2727$$

where:

60 represents the number of revolutions per second produced by motor 28 in shaft 26, and 55 represents the desired rotational speed for shaft 30 relatable to the frequency of 55 Hz.

Progressing to the left along shaft 30 from location 32, the outside diameter of the shaft tapers in accordance with the logarithmic mathematical formula presented above. It will be appreciated that with the outside of shaft 30 so tapered, the spacings along the shaft of the points thereon which are related to the other 12 tones in an octave are equal. With shaft 30 having an overall length of about 6 inches, as indicated, it was arbitrarily decided to make each of such spacings about .42 inches. Accordingly, and as can be seen in FIG. 2, progressing to the left along shaft 30 from line 32 are 12 other equally spaced dash-double-dot lines evenly numbered 32–56, inclusive. Table II below indicates the diameters of the shaft at the locations of lines 32–56, inclusive, as well as the particular notes in the scale of an octave to which these diameters directly relate.

TABLE II

| Note | Shaft Diameter |
|---|---|
| A | .2727 |
| G# | .2889 |
| G | .3061 |
| F# | .3243 |
| F | .3436 |
| E | .3640 |
| D# | .3857 |
| D | .4086 |
| C# | .4329 |
| C | .4587 |
| B | .4859 |
| A# | .5148 |
| A | .5454 |

Calculations for deriving these shaft diameters are performed as follows:

| | |
|---|---|
| Note G# | Diameter = $(1.0594631)^1 \times .2727 = .2889''$ |
| Note G | Diameter = $(1.0594631)^2 \times .2727 = .3061''$ |
| Note F# | Diameter = $(1.0594631)^3 \times .2727 = .3243''$ |
| Note F | Diameter = $(1.0594631)^4 \times .2727 = .3436''$ |
| Note E | Diameter = $(1.0594631)^5 \times .2727 = .3640''$ |
| Note D# | Diameter = $(1.0594631)^6 \times .2727 = .3857''$ |
| Note D | Diameter = $(1.0594631)^7 \times .2727 = .4086''$ |
| Note C# | Diameter = $(1.0594631)^8 \times .2727 = .4329''$ |
| Note C | Diameter = $(1.0594631)^9 \times .2727 = .4587''$ |
| Note B | Diameter = $(1.0594631)^{10} \times .2727 = .4859''$ |
| Note A# | Diameter = $(1.0594631)^{11} \times .2727 = .5148''$ |
| Note A | Diameter = $(1.0594631)^{12} \times .2727 = .5454$ |

Figure 4:
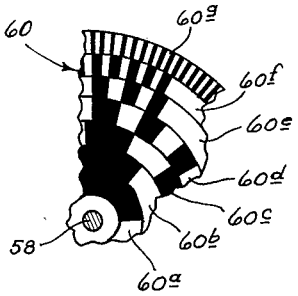
FIG. 4 is a fragmentary view of a conventional strobe wheel used in the device of FIG. 1.

Considering now FIG. 4 along with FIGS. 1 and 2, the right end of shaft 30 in FIG. 2 joins with a spindle 58 which projects through plate 20 to the space between this plate and end 12*e* in the housing. Suitable mounted on the right end of spindle 58 in FIG. 2 is a conventional strobe wheel 60 which is visually divided into seven concentric circles, each of which contains alternating light-opaque and light-transmissive regions. These seven circles are indicated partially in FIG. 4 at 60*a*-60*g*, inclusive, in FIG. 1. The markings in circle 60*a* relate to the frist octave of notes indicated in Table I, those in circle 60*b* to frequencies in the second octave, and so on to the markings within circle 60*g* which relate to the seventh octave. Wheel 60 is exposed for viewing through a window 62 formed in end 12*e* of housing 12. However, in order to simplify FIG. 1, the actual markings on the wheel are not shown in the window.

Drive for shaft 30 is imparted herein through an endless elastic band 64 which is trained over this shaft as well as over shaft 26. The specific position along shafts 26, 30 occupied by band 64 is determined by an adjustment mechanism, shown generally at 66, which includes an elongated screw 68 and a rider 70 which is threaded onto this screw. The opposite ends of screw 68 are suitably journaled on plates 18, 20, with the rotational axis of the screw substantially paralleling those of shafts 26, 30. The right end of screw 68 in FIG. 2 joins with a shaft 72 which projects through plate 20 and through housing end 12*e*, and whose outer end carries an adjustment knob 74.

Figure 3:
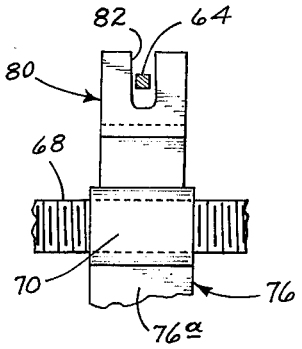
FIG. 3 is an enlarged fragmentary view taken generally along the line 3—3 in FIG. 2.

Considering FIG. 3 now along with FIGS. 1 and 2, rider 70 takes the form of a cylindrical collar which is threaded onto the screw, and joned with this collar is a pointer 76 having a horizontal forwardly projecting portion 76*a* which projects through an elongated horizontal slot 78 that is formed in plate 22—with portion 78*a* joining integrally with an upturned triangular portion 76*b* that is exposed on the outer front side of plate 22. Joined with collar 70, on the far side thereof from pointer 76, is a slotted guide 80 having a slot 82 which freely receives one run of band 64.

With turning of knob 74, screw 68 rotates, and causes rider 70 to travel along the screw in the particular direction dictated by the direction of rotation of the knob. With such action, the outer triangular end of pointer 76 moves back and forth along the outer face of plate 22, and at the same time, guide 80 exerts lateral pressure on band 64 causing this band to shift its position along shafts 26, 30. In FIG. 2, band 64 is shown in an axial position coupling shaft 26 with shaft 30 at the location of previously mentioned line 38—which line corresponds, per Table II, with the note F#.

Mounted on the outside of plate 22 immediately above slot 78 is an elongated marking strip 84 (see FIG. 1) on which are provided indicia naming twelve of the thirteen notes in an octave. The positions of these indicia correspond along the marking strip exactly with the locations of lines 34–56 previously referred to with respect to shaft 30. Since it is only necessary to have each of the different notes in a scale of notes represented once, only one location is assigned to the note A—this being adjacent the left end of strip 84 and associated with line 56.

Figure 5:
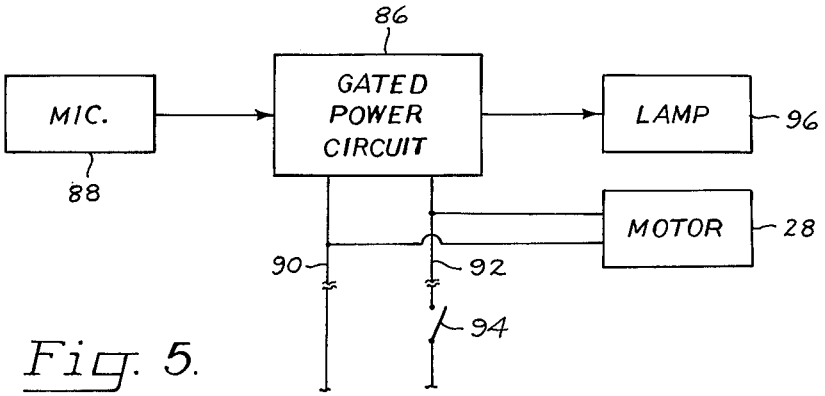
FIG. 5 is a block diagram of certain electrical components used in the device of FIG. 1.
Figure 6:
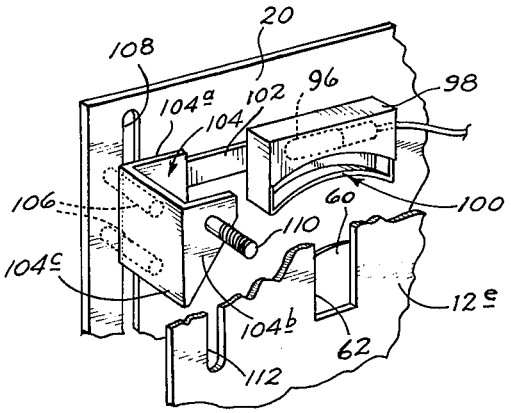
FIG. 6 is a fragmentary perspective view illustrating a movable mounting provided in the device of FIG. 1 for a flashing lamp which is used in conjunction with a rotary strobe wheel in the device.

Completing a description of device 10, and considering FIGS. 5 and 6 now along with the other drawing figures, suitably mounted within housing 12 is a gated electronic power circuit 86 which may be of conventional construction. Input information for this circuit is provided by a microphone 88 which is also mounted within the housing. Preferably, microphone 88 is mounted on base 12*a*, and is exposed through a suitable opening provided adjacent the microphone. Power for circuit 86 is provided through conductors 90, 92 which extend to a conventional on-off power switch 94 actuated by a knob 95 (see FIG. 1). Switch 94 is intended, in turn, to be coupled in the usual way to a conventional source of household-type AC power. The output of circuit 86 is coupled to a neon lamp 96. Motor 28 couples directly to conductors 90, 92. In FIG. 2, lamp 96 is represented simply schematically as a circle located in the space between plate 20 and wheel 60. A specific mounting for this lamp is shown in more detail in FIG. 6, and will be discussed shortly.

With power supplied through conductors 90, 92, power circuit 86 flashes lamp 96 at the frequency of whatever note is detected by microphone 88. Those skilled in the art will recognize that this type of arrangement is entirely conventional. Hence, none of the details of circuit 86 are discussed herein.

Turning now specifically to FIG. 6, a special mounting is contemplated for lamp 96 to facilitate the reading of wheel 60. It should be understood that while such a mounting is shown herein, the apparatus of the invention functions completely satisfactorily without this mounting, and with lamp 96 simply positioned openly in the space between wheel 60 and plate 20.

Lamp 96 is mounted within the upper portion of a specially shaped housing 98, the upper portion of which is closed, and the lower portion of which includes an arcuate opening 100 that faces end 12*e* in housing 12. Housing 98 is mounted on a bracket 102 which attaches to a rider 104. Rider 104 includes an ear 104*a* which is disposed closely adjacent plate 20, another ear 104*b* which is disposed closely adjacent housing end 12*e*, and a central portion 104*c* which joins with and interconnects ears 104*a*, 104*b*. Mounted on ear 104*a* are two vertically spaced horizontally projecting pins 106 which project through a vertical slot 108 formed in plate 20. Joined to ear 104*b* is a threaded horizontal pin 110 which projects through a vertical slot 112 formed in housing ends 12*e* immediately to the left of window 62.

Mounted on the outer end of threaded pin 110 are a pointer 114 which is suitably keyed to the pin so as to maintain its angular position thereon shown in FIG. 1, and a threaded head 116. As can be seen, pointer 114 points generally to the right in FIG. 1, and specifically, is intended to point to a selected one of seven vertically spaced indicia dots such as those shown at 118. These seven dots relate to the seven full octaves presented in Table I above.

When it is desired to set up device 10 for the tuning of notes in the lowest octave, head 116 is loosened, and is then manipulated to lower rider 104, and hence housing 98 and lamp 96, to a position with pointer 114 pointing to the lowest dot of dots 118. The head is then retightened to clamp this mechanism in place. Such positioning of the mechanism locates opening 100 immediately behind the innermost circle 60*a* in wheel 60. Similarly, when it is desired to tune notes of the other six octaves, the mechanism just described is adjusted to the suitable one of dots 118, thereby to position opening 100 behind the related circle in the strobe wheel. With such an arrangement, light flashes from lamp 96 are confined to exposure through a selected one of the circle of markings of the strobe wheel. This, of course, simplifies reading of the wheel. It should be noted here also that markings have been omitted on the fragment of wheel 60 shown in FIG. 6 so as to simplify the figure.

It is believed to be fairly obvious now how the apparatus of the invention may be used. To use device 10, the power switch is turned on and the device placed with microphone 88 adjacent the instrument which is to be tuned. The octave in which tuning is to begin is selected, and lamp 96 positioned appropriately. Assuming that turning is to begin with note A in the octave, knob 74 is turned to shift rider 70 to a position placing band 64 at the location along shafts 26, 30 of previously mentioned line 56. Under this circumstance, the triangular portion of pointer 76 will point to indicia A on strip 84. Because of the taper (derived as defined above) on the outside of shaft 30, constant-speed shaft 26 will rotate shaft 30 at the appropriate rotational speed for wheel 60. Note A in the selected octave is then played on the instrument, picked up by microphone 88, and represented by flashes of lamp 96 which are then read through the strobe wheel. Tuning is then performed in the usual way to bring the note into proper tone wherein there is no apparent relative movement of indicia in the strobe wheel. To tune the next successive note or semitone in the octave, knob 74 is adjusted now to shift band 64 to the location of line 54 which relates to note A#. Tuning then progresses in the manner just described.

It has been found that the apparatus of the present invention is capable of producing extremely accurate results. Further, because of the logarithmic taper provided in shaft 30, spacings between successive semitones for the indicia in marking strip 84 are equal. As a consequence, and should it be desired, it is a relatively simple matter to determine, in terms of percentage, how much out of tune any particular note in an instrument is. Further, with such uniform constant spacing distribution, it is an easy matter to set up device 10 for the tuning of a particular selected note.

Obviously, the mechanism which has been described for the invention is relative simple in construction. An interesting feature of the invention is that in the case of some standard other than A-440 being used, for example, A-435, all that one need do to equip device 10 to handle this standard is to provide it with laterally slidable marking strip like strip 84. The spacings between the respective successive semitones will remain constant, and all that will be required is slight lateral shifting of the marking strip so as to take into account the slight shifting of the positions of lines 32–56 along shaft 30 which relate to the semitones in an octave in this different standard.

While a preferred embodiment of the invention, and certain modifications thereof, have been shown and described herein, it is appreciated that other variations and modifications may be made without departing from the spirit of the invention.

It is claimed and desired to secure by letters patent:

1. Tuning apparatus for a musical instrument the notes of which are intended to be frequency-distributed in accordance with a known mathematical formula, said apparatus comprising a strobe wheel mounted for rotation, an elongated shaft for rotating said wheel operatively connected thereto, said shaft including an elongated non-stepped unidirectionally tapered outside surface of revolution extending at least partially along its length, the taper of said surface directly relating to said known mathematical formula, and substantially constant-speed drive means for driving said shaft, said drive means including means infinitely adjustable to impart drive to said shaft an an infinite number of points distributed in unbroken adjacency along the full length of said surface, thus to drive the shaft at different speeds.

2. The apparatus of claim 1, wherein said mathematical formula is $F_n = F_0 \times b^n$, where $F_n$ is the desired frequency of the nth note above the lowest note of the instrument, $F_0$ is the frequency of the lowest note in the instrument, $n$ is the number of the desired note above the lowest note in the instrument, and $b = 1.0594631$.

3. Tuning apparatus for a musical instrument, the notes of which are intended to be frequency-distributed in accordance with a selected-logarithmic relationship, said apparatus comprising a strobe wheel mounted for rotation, an elongated shaft for rotating said wheel operatively connected thereto, said shaft including an elongated, non-stepped logarithmically tapered outside surface of revolution extending at least partially along its length, the logarithmic taper of said surface directly relating to said selected logarithmic relationship, and substantially constant-speed drive means for driving said shaft, said drive means including means infinitely adjustable to impart drive to said shaft at an infinite number of points distributed in unbroken adjacency along the full length of said surface, thus to drive the shaft at different speeds.

4. The apparatus of claim 3, wherein the length of said surface is sufficient to cover a two-to-one ratio of frequencies.

5. The apparatus of claim 3, wherein said drive means comprises an elongated substantially uniform-diameter drive shaft, and said adjustable means comprises an endless band coupling said drive shaft and said first-mentioned shaft.

6. Apparatus for turning a strobe wheel to assist in the tuning of a musical instrument, where the intended frequency intervals between the notes of the instrument are determined in accordance with a known mathematical formula, and the wheel is provided with strobe markings spaced in accordance with such intervals said apparatus comprising an elongated rotary drive shaft having an elongated uniform-diameter cylindrical drive surface, means operatively connected to said drive shaft for rotating the same at a substantially constant speed, an elongated rotary output shaft adapted to be drivingly connected to such a strobe wheel, mounted for rotation in side-by-side substantially parallel adjacency with respect to said drive shaft, said output shaft including an elongated drive-receiving surface which is unidirectionally non-steppedly tapered along its length with a taper directly related to said mathematical formula, an endless-type drive band operatively interconnecting said drive shaft and said output shaft for imparting rotary drive from the former to the latter, and means for adjusting the position, along the respective lengths of said shaft, where said band engages the shaft, said taper establishing substantially equaldistance intervals along said shaft for the driving positions of said band which positions result in turning of such a strobe wheel at respective rates directly related to the successive adjacent notes in such an instrument.

7. The apparatus of claim 6, wherein said mathematical formula is $F_n = F_0 \times b^n$, where $F_n$ is the desired frequency of the nth note above the lowest note in the instrument, $F_0$ is the frequency of the lowest note, $n$ is the number of the note above the lowest note, and $b = 1.0594631$.

8. The apparatus of claim 6, wherein the length of said taper along said output shaft is sufficient to cover an octave of notes.

9. The apparatus of claim 7, wherein the length of said taper along said output shaft is sufficient to cover an octave of notes.

10. The apparatus of claim 4, wherein said adjusting means comprises means engageable with said drive band for shifting it back and forth along the shafts.

11. The apparatus of claim 8, wherein said adjusting means is infinitely adjustable.

* * * * *

UNITED STATES PATENT AND TRADEMARK OFFICE

CERTIFICATE OF CORRECTION

PATENT NO. : 4,038,899

DATED : August 2, 1977

INVENTOR(S) : Roderic A. MacMillan

It is certified that error appears in the above-identified patent and that said Letters Patent are hereby corrected as shown below:

In column 10, line 13, delete "the" and insert --said--.

Signed and Sealed this

*Twenty-second* Day of *April 1980*

[SEAL]

*Attest:*

SIDNEY A. DIAMOND

*Attesting Officer*

*Commissioner of Patents and Trademarks*